US010125552B2

(12) United States Patent
Zhao et al.

(10) Patent No.: US 10,125,552 B2
(45) Date of Patent: Nov. 13, 2018

(54) CONVEX RIDGE TYPE NON-PLANAR CUTTING TOOTH AND DIAMOND DRILL BIT

(71) Applicant: CNPC USA CORPORATION, Houston, TX (US)

(72) Inventors: Liang Zhao, Houston, TX (US); Xiaomin Cheng, Houston, TX (US); Demin Chen, Houston, TX (US); Xiongwen Yang, Houston, TX (US); Yonghong Wang, Houston, TX (US); Yu Liu, Houston, TX (US)

(73) Assignee: CNPC USA Corporation, Houston, TX (US)

( * ) Notice: Subject to any disclaimer, the term of this patent is extended or adjusted under 35 U.S.C. 154(b) by 0 days.

(21) Appl. No.: 15/248,501

(22) Filed: Aug. 26, 2016

(65) Prior Publication Data

US 2017/0058615 A1 Mar. 2, 2017

(30) Foreign Application Priority Data

Aug. 27, 2015 (CN) ..... 2015 1 0533014

(51) Int. Cl.
*E21B 10/567* (2006.01)

(52) U.S. Cl.
CPC ..... *E21B 10/5673* (2013.01)

(58) Field of Classification Search
CPC ..... E21B 10/5673
See application file for complete search history.

(56) References Cited

U.S. PATENT DOCUMENTS 4,190,126 A 2/1980 Kabashima
4,562,892 A 1/1986 Ecer
(Continued)

FOREIGN PATENT DOCUMENTS

CA 2859386 A1 5/2016
CN 201891385 U 7/2011
(Continued)

OTHER PUBLICATIONS

Office Action dated Dec. 25, 2016, in Chinese Application No. 201020670147.9.
(Continued)

*Primary Examiner* — Nicole Coy
*Assistant Examiner* — Kristyn A Hall
(74) *Attorney, Agent, or Firm* — Ramey & Schwaller, LLP

(57) ABSTRACT

The present invention provides a convex ridge type non-planar cutting tooth and a diamond drill bit, the convex ridge type non-planar cutting tooth comprises a cylindrical body, the surface of the end portion of the cylindrical body is provided with a main cutting convex ridge and two non-cutting convex ridges, the inner end of the main cutting convex ridge and the inner ends of the two non-cutting convex ridges converge at the surface of the end portion of the cylindrical body, the outer end of the main cutting convex ridge and the outer ends of the two non-cutting convex ridges extend to the outer edge of the surface of the end portion of the cylindrical body, the surfaces of the end portion of the cylindrical body on both sides of the main cutting convex ridge are cutting bevels. The convex ridge type non-planar cutting tooth and the diamond drill bit have great ability of impact resistance and balling resistance. According to the features of drilled formation, convex ridge type non-planar cutting teeth are arranged on the drill bit with different mode, which can improve the mechanical speed and footage of the drill bit.

19 Claims, 7 Drawing Sheets

(56) References Cited

U.S. PATENT DOCUMENTS

| | | | |
|---|---|---|---|
| 4,592,252 | A | 6/1986 | Ecer |
| 4,697,653 | A | 10/1987 | Peterson |
| 4,722,405 | A | 2/1988 | Langford, Jr. |
| 5,099,932 | A | 3/1992 | Hixon |
| 5,176,212 | A | 1/1993 | Tandberg |
| 5,647,448 | A | 7/1997 | Skaggs |
| 5,881,830 | A | 3/1999 | Cooley |
| 6,059,054 | A | 5/2000 | Portwood et al. |
| 6,095,262 | A | 8/2000 | Chen |
| 6,347,676 | B1 | 2/2002 | Vuyk, Jr. |
| 6,390,087 | B1 | 5/2002 | Wentworth et al. |
| 6,412,577 | B1 | 7/2002 | Chen |
| 6,450,269 | B1 | 9/2002 | Wentworth et al. |
| 7,228,922 | B1 | 6/2007 | DeVall |
| 7,681,673 | B2 | 3/2010 | Kolachalam |
| 7,686,106 | B2 | 3/2010 | Baker et al. |
| 8,590,644 | B2 | 11/2013 | Hall et al. |
| 2001/0018990 | A1 | 9/2001 | Asberg et al. |
| 2002/0011355 | A1 | 1/2002 | Wentworth et al. |
| 2002/0096367 | A1 | 7/2002 | Wentworth et al. |
| 2003/0150651 | A1 | 8/2003 | Sved |
| 2003/0159543 | A1 | 8/2003 | Griffo |
| 2004/0065482 | A1 | 4/2004 | Larsson |
| 2004/0188148 | A1 | 9/2004 | Chen |
| 2005/0023043 | A1 | 2/2005 | Tufts |
| 2005/0084349 | A1 | 4/2005 | Kammerer et al. |
| 2006/0090937 | A1 | 5/2006 | McDonough |
| 2010/0263939 | A1 | 10/2010 | Hall et al. |
| 2011/0031029 | A1* | 2/2011 | Gavia ..... E21B 10/43 175/428 |
| 2014/0076639 | A1 | 3/2014 | Vo et al. |
| 2014/0231142 | A1 | 8/2014 | Poitzsch |
| 2017/0030144 | A1* | 2/2017 | Rahmani ..... E21B 10/5673 |

FOREIGN PATENT DOCUMENTS

| | | | |
|---|---|---|---|
| CN | 104594806 | A | 5/2015 |
| CN | 104675332 | A | 6/2015 |
| CN | 104675333 | A | 6/2015 |
| GB | 1534535 | A | 12/1978 |
| GB | 2117428 | A | 10/1983 |
| GB | 2361497 | A | 10/2001 |
| GB | 2365899 | A | 2/2002 |
| GB | 2368601 | A | 5/2002 |
| GB | 2393746 | A | 4/2004 |
| GB | 2399526 | A | 9/2004 |
| RU | 2011133942 | A | 2/2013 |
| WO | 0012860 | A2 | 3/2000 |
| WO | 2010036833 | A2 | 4/2010 |
| WO | 2010048116 | A2 | 4/2010 |
| WO | 2013170788 | A1 | 11/2013 |

OTHER PUBLICATIONS

Office Action dated Apr. 24, 2017, in Chinese Application No. 201020670147.9.

* cited by examiner

CONVEX RIDGE TYPE NON-PLANAR CUTTING TOOTH AND DIAMOND DRILL BIT

RELATED APPLICATIONS

This application claims priority to Patent Application CN2015105330144 filed on Aug. 27, 2015, which is specifically incorporated by reference in its entirety herein.

FIELD

The disclosure relates generally to a cutting tooth and drill bit. The disclosure relates specifically to a convex ridge type non-planar cutting tooth and diamond drill bit in the field of drill bits used in petroleum exploration and drilling operation.

BACKGROUND

At present, diamond drill bits are widely used in petroleum exploration and drilling operation. This kind of bit consist of a bit body part and diamond composite sheet cutting tooth, the bit body part is made of sintered tungsten carbide material or is formed by processing a metal material as a substrate, and the diamond composite sheet cutting tooth is brazed to the front end of the cutting face of the blade of the bit. In the drilling process, diamond composite sheet cuts rock and withstands great impact from the rock at the same time. They are prone to impact damage when drilling into a high gravel content formation or a hard formation, resulting in damage to the cutting faces. On the other hand, when drilling in shale, mudstone and other formations, the debris produced by cutting through diamond composite sheet can easily form a long strip shape debris. Due to the large size of this kind of debris, it will easily attach to the blades and body part of the bit to form balling, such that the cutting work faces of the blades of the bit are wrapped and unable to continue working, eventually leading to decrease of mechanical speed, no drill footage and other issues. The day rate is very high during the process of drilling. The replacement of the drill bit in virtue of the poor impact resistance or as a result of the decreased mechanical speed owning to the balling will bring high economic costs, so it has become a top priority to effectively improve the ability of impact resistance and the balling resistance of the drill bit.

SUMMARY

The object of the present invention is to provide a convex ridge type non-planar cutting tooth having great impact resistance and balling resistance. The convex ridge type non-planar cutting teeth are mounted on a drill bit to increase the mechanical speed and footage of the drill bit.

Another object of the present invention is to provide a diamond drill bit, convex ridge type non-planar cutting teeth are arranged on the diamond drill bit, which can effectively improve the impact resistance and balling resistance of the drill bit, thus to increase the mechanical speed and footage of the drill bit.

The above objects of the present invention can be achieved by employing the following technical solutions:

The present invention provides a convex ridge type non-planar cutting tooth comprising a cylindrical body, the surface of the end portion of the cylindrical body is provided with a main cutting convex ridge and two non-cutting convex ridges, the inner end of the main cutting convex ridge and the inner ends of the two non-cutting convex ridges converge at the surface of the end portion of the cylindrical body, the outer end of the main cutting convex ridge and the outer ends of the two non-cutting convex ridges extend to the outer edge of the surface of the end portion of the cylindrical body, the surfaces of the end portion of the cylindrical body on both sides of the main cutting convex ridge are cutting bevels.

In a preferred embodiment, the surface of the end portion of the cylindrical body between the two non-cutting convex ridges is a back bevel.

In a preferred embodiment, the surface of the end portion of the cylindrical body between the two non-cutting convex ridges is a back plane.

In a preferred embodiment, the cylindrical body comprises a base formed of tungsten carbide material and a polycrystalline diamond layer connected to the top of the base, the main cutting convex ridge and two non-cutting convex ridges are located on the upper surface of the polycrystalline diamond layer.

In an embodiment, the cylindrical body comprises a base including but not limited to high speed steel, carbon steel, titanium, cobalt, or tungsten carbide. In an embodiment, the layer at the top of the base is comprised of a diamond layer including but not limited to metal-bonded diamond, resin-bonded diamond, plated diamond, ceramic-bonded diamond, polycrystalline diamond, polycrystalline diamond composite, or high temperature brazed diamond tools.

In a preferred embodiment, the angle between the two cutting bevels is 150° to 175°.

In an embodiment, the angle between the two cutting bevels is 90° to 175°.

In a preferred embodiment, the length of the main cutting convex ridge is equal to that of the non-cutting convex ridges.

In an embodiment, the length of the main cutting convex ridge is not equal to that of the non-cutting convex ridges.

In a preferred embodiment, the length of the main cutting convex ridge is larger than that of the non-cutting convex ridges.

In an embodiment, the length of the main cutting convex ridge is smaller than that of the non-cutting convex ridges.

In a preferred embodiment, the length of the main cutting convex ridge is ½-⅔ times of the diameter of the cylindrical body.

The present invention also provides a diamond drill bit, comprising:

a drill bit body equipped with an axial through water channel therein, a connection portion is formed at one end of the drill bit body, the other end of the drill bit body is provided with a plurality of water holes which can communicate with the water channel;

a plurality of blades connected to the other end of the drill bit body in the circumferential direction, one side of each of the blade equipped with a plurality of cutting teeth side by side, the plurality of cutting teeth comprise said convex ridge type non-planar cutting teeth.

In a preferred embodiment, the blade has an inner side and outer side surface, a top surface of the blade is connected between the inner side surface and outer side surface. the plurality of the cutting teeth are disposed on the outer edge of the top surface of the blade and near the inner side surface; the top surface of the blade comprises a heart portion, a nose portion, a shoulder portion and a gauge protection portion connected in turn which are extended from the center shaft diameter of the drill bit body to outside, the heart portion is close to the central axis of the drill bit body, the gauge protection portion is located on the side wall of the drill bit body and the cutting teeth are distributed across the heart portion, the nose portion, the shoulder portion and the gauge protection portion of the blade.

In a preferred embodiment, a plurality of blades are further provided with a plurality of secondary cutting teeth. The secondary cutting teeth are arranged in the back row of the cutting teeth along the rotary cutting direction of the drill bit body, the plurality of secondary cutting teeth include the convex ridge type non-planar cutting tooth.

In a preferred embodiment, the convex ridge type non-planar cutting teeth are arranged on the heart portion of the blade.

In a preferred embodiment, the convex ridge type non-planar cutting teeth are arranged on the shoulder portion of the blade.

In a preferred embodiment, the convex ridge type non-planar cutting teeth are arranged on the nose portion of the blade.

In a preferred embodiment, the convex ridge type non-planar cutting teeth are arranged on the gauge protection portion of the blade.

In a preferred embodiment, the convex ridge type non-planar cutting teeth are arranged on more than one portion of the blade.

In a preferred embodiment, the convex ridge type non-planar cutting teeth are arranged on the heart, shoulder, nose, and gauge portions of the blade.

In a preferred embodiment, the convex ridge type non-planar cutting teeth and the cutting teeth are arranged in a staggered arrangement along the axial direction of the drill bit body.

In a preferred embodiment, the convex ridge type non-planar cutting teeth and the cutting teeth are arranged in an aligned arrangement along the axial direction of the drill bit body.

The characteristics and advantages of the convex ridge type non-planar cutting teeth and the diamond drill bit according to the present invention are:

1. The convex ridge type non-planar cutting tooth of the present invention changes the traditional plane cylindrical cutting tooth design into a convex ridge type non-planar cutting tooth, which can greatly improve the ability of positive direction impact resistance of the cutting tooth; In addition, the main cutting convex ridge which is located at the outer end of the edge of the upper surface of the polycrystalline diamond layer acts as a cutting point. In the process of cutting, the debris can be automatically formed into two branches from the cutting point, and can be squeezed out from the cutting bevels on both sides of the main cutting convex ridge, such that the debris is prevented from sliding to the body part of the blade along the upper surface of the polycrystalline diamond layer and forming balling, thus greatly improving the ability of balling resistance of the cutting tooth.

2. When drilling into a formation that is easy to form balling, the diamond drill bit of the present invention arranges the convex ridge type non-planar cutting teeth in the heart portion, such that the size of the debris produced by the cutting teeth in the heart portion can be reduced, and the debris can be easier to be carried out of bottom of a well by drilling fluid, thus to reduce the risk of bit balling. In addition, when drilling into a gravel content formation and the like, the convex ridge type non-planar cutting teeth are arranged on the shoulder portion, therefore to improve the ability of impact resistance of the drill bit. Furthermore, when drilling into a high impact formation, the convex ridge type non-planar cutting teeth are arranged on the shoulder portion and the outer side of the nose portion, thus to improve the ability of impact resistance of the cutting teeth in these areas, and to improve the life of drill bit. Of course, the convex ridge type non-planar cutting teeth may also be arranged in the position of the secondary cutting teeth of the blade of the diamond drill bit to accommodate the needs of drilling into different formations.

The foregoing has outlined rather broadly the features of the present disclosure in order that the detailed description that follows may be better understood. Additional features and advantages of the disclosure will be described hereinafter, which form the subject of the claims.

BRIEF DESCRIPTION OF THE DRAWINGS

In order that the manner in which the above-recited and other enhancements and objects of the disclosure are obtained, a more particular description of the disclosure briefly described above will be rendered by reference to specific embodiments thereof which are illustrated in the appended drawings. Understanding that these drawings depict only typical embodiments of the disclosure and are therefore not to be considered limiting of its scope, the disclosure will be described with additional specificity and detail through the use of the accompanying drawings in which.

DETAILED DESCRIPTION

The particulars shown herein are by way of example and for purposes of illustrative discussion of the preferred embodiments of the present disclosure only and are presented in the cause of providing what is believed to be the most useful and readily understood description of the principles and conceptual aspects of various embodiments of the disclosure. In this regard, no attempt is made to show structural details of the disclosure in more detail than is necessary for the fundamental understanding of the disclosure, the description taken with the drawings making apparent to those skilled in the art how the several forms of the disclosure may be embodied in practice.

EXAMPLES

Example 1

Figure 1:
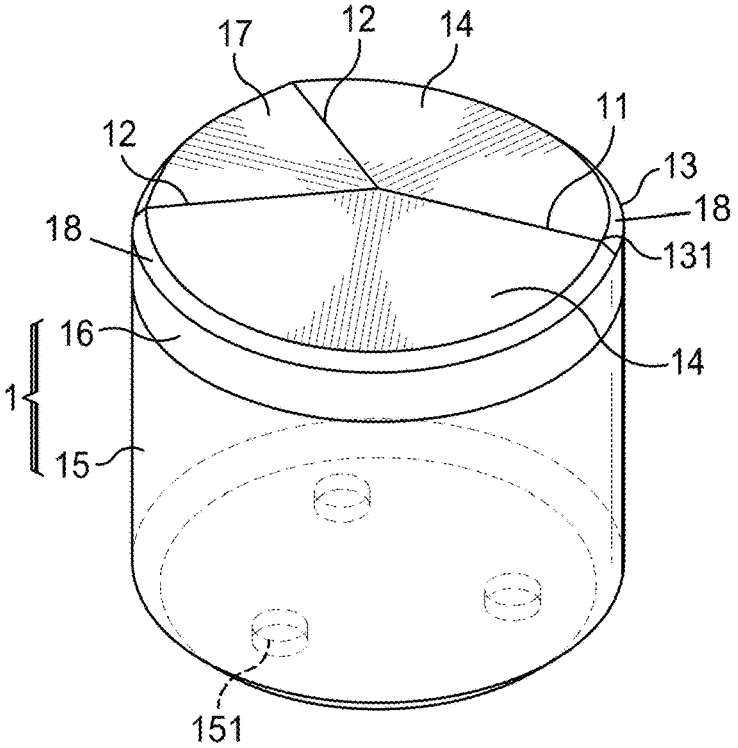
FIG. 1 is a perspective view of a convex ridge type non-planar cutting tooth in accordance with one embodiment disclosed herein.
Figure 2:
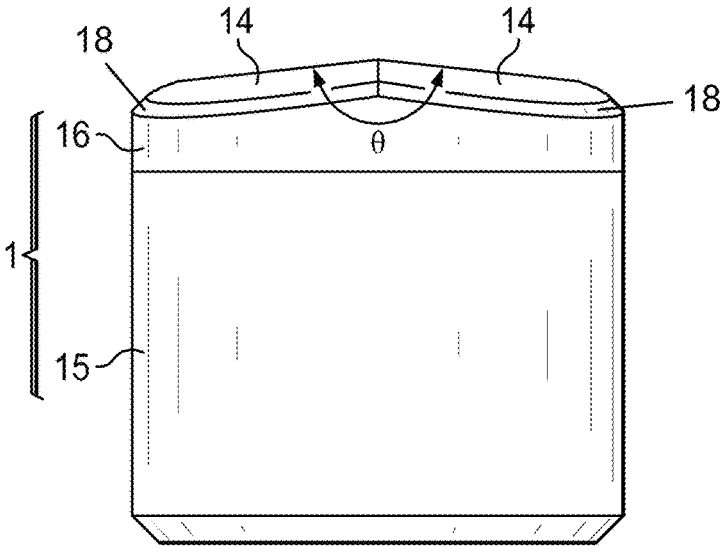
FIG. 2 is a front view of a convex ridge type non-planar cutting tooth in accordance with one embodiment disclosed herein.

Referring to FIGS. 1 and 2, the present invention provides a convex ridge type nonplanar cutting tooth, which comprise a cylindrical body 1, the surface of the end portion of the cylindrical body 1 is provided with a main cutting convex ridge 11 and two non-cutting convex ridges 12, the inner end of the main cutting convex ridge 11 and the inner ends of the two noncutting convex ridges 12 converge at the surface of the end portion of the cylindrical body 1, the outer end of the main cutting convex ridge 11 and the outer ends of the two non-cutting convex ridges 12 extend to the outer edge 13 of the surface of the end portion of the cylindrical body 1, the surfaces of the end portion of the cylindrical body 1 on both sides of the main cutting convex ridge 11 are cutting bevels 14. Chamfered surfaces 18 are present.

Specifically, the cylindrical body 1 comprises a base 15 formed of tungsten carbide material and a polycrystalline diamond layer 16 connected to the top of the base, the main cutting convex ridge 11 and two non-cutting convex ridges 12 are located on the upper surface of the polycrystalline diamond layer 16, and a plurality of welding positioning holes 151 are arranged on the lower surface of the base 15.

Material properties of polycrystalline diamond are determined mainly by the selected particles scale during sintering, polycrystalline diamond having an average particle dimension between 1 μm to 50 μm after sintering. The smaller the particle size, the wear resistance of the sintered polycrystalline diamond is higher, but the corresponding impact resistance is lower. In the present invention, through testing the wear resistance of the convex ridge type non-planar cutting tooth by vertical lathe test, it is found that the wear of the convex ridge type non-planar cutting tooth is relatively lower than that of the conventional plane tooth. So, smaller particle size should be used for sintering. The average particle dimension of the sintered polycrystalline diamond layer 16 is from 1 μm to 25 μm according to the present invention.

Further, the inner end of the main cutting convex ridge 11 and the inner ends of the two non-cutting convex ridges 12 converge at the middle of the upper surface of the polycrystalline diamond layer 16, the outer end of the main cutting convex ridge 11 and the outer ends of the two non-cutting convex ridges 12 extend to the outer edge 13 of the upper surface of the polycrystalline diamond layer 16. Chamfered surfaces 18 are present. Viewed from the top of the polycrystalline diamond layer 16, the main cutting convex ridge 11 and the two non-cutting convex ridges 12 form a substantially "Y" type pattern, and the main cutting convex ridge 11 and the two noncutting convex ridges 12 divide the upper surface of the polycrystalline diamond layer 16 into three surfaces. The upper surface of the polycrystalline diamond layer 16 located on both sides of the main cutting ridge 11 are cutting bevels 14, the cutting bevels 14 extend along an axial direction from the center of the cylindrical body 1 outwardly and downwardly. The upper surface of the polycrystalline diamond layer 16 between the two non-cutting convex ridges 12 (i.e., the surface of the end portion of the cylindrical body 1) is a back surface 17. That is, the cutting bevels 14 are divided by the back surface 17 on the side away from the outer end of the main cutting convex ridge 11, and the cutting bevels 14 do not meet at the far end.

When cutting shale, mudstone and other formations with the convex ridge type nonplanar cutting tooth, the two cutting bevels 14 separate the strip shape debris cut by conventional planar diamond composite sheet into two smaller size debris. Chamfered surfaces 18 are present. The portions of the two cutting bevels 14 which are away from the cutting point 131 are divided by the backplane 17, and do not directly converge at the surface of the blade of the drill bit, so the debris will not be attached directly to the blade of the drill bit in more cases, but will be dispersed along the two cutting bevels 14 in drilling fluid and be carried out of the bottom of a well, which will greatly reduce the balling produced by debris attached to the blade of the drill bit and wrapping the cutting work face, thereby improving the life of the drill bit, increasing mechanical speed and drill footage.

After cutting rock with the convex ridge type non-planar cutting teeth and conventional planar cutting teeth in the same test parameters, filtering analysis of the degree of coarse of debris through the filter screen, it can be seen that the ratio of the debris passing through the #40 filter screen (fine debris) to debris produced by the convex ridge type non-planar cutting teeth is higher than that of the debris passing through the #40 filter screen to debris produced by the conventional planar cutting teeth, and that the ratio of the debris not passing through the #40 filter screen (coarse debris) to debris produced by the convex ridge type non-planar cutting teeth is lower than that of the debris not passing through the #40 filter screen to debris produced by the conventional planar cutting teeth, which shows that the convex ridge type non-planar cutting teeth can produce finer debris under the same cutting conditions, thereby improving the ability to carry the debris out of the bottom of a well by drilling fluid, and reducing the risk of forming bit balling.

Polycrystalline diamond layer 16 of the present invention is designed to adopt a non-planar convex ridge, which has higher impact resistance than conventional planar diamond composite sheet. By performing benchmarking experiments using the impact fatigue testing machine, performance figures of impact resistance of both can be obtained and compared. The composite layer of a test sample is fixed on the flywheel of the impact fatigue testing machine through a special clamp, a motor drives the flywheel to rotate. In every revolution to the position of nine o'clock, the test sample impacts a striking block fixed to the left side and supported by a spring, rotating the flywheel for repeated impact until the test sample is destroyed. The impact fatigue property of the sample was evaluated by the number of recorded impacts before the failure. If damage occurs in the process of impact test, the test should be stopped immediately; and if the impact is up to 12,000 times and the sample is not damaged yet, the test should also be stopped. (In the actual test, because there are time lag effects in counter and the flywheel, the actual number of the impact of samples may slightly above 12,000 after the stop). After four cutting teeth which are sintered with different grain size diamond are machined into convex ridge type non-planar cutting teeth, they withstand impact fatigue test and are compared with planar cutting teeth with the same size sintered diamond. The experimental results show that the ability of positive direction impact resistance of convex ridge type non-planar cutting teeth is much higher than that of conventional planar cutting teeth.

Figure 3:
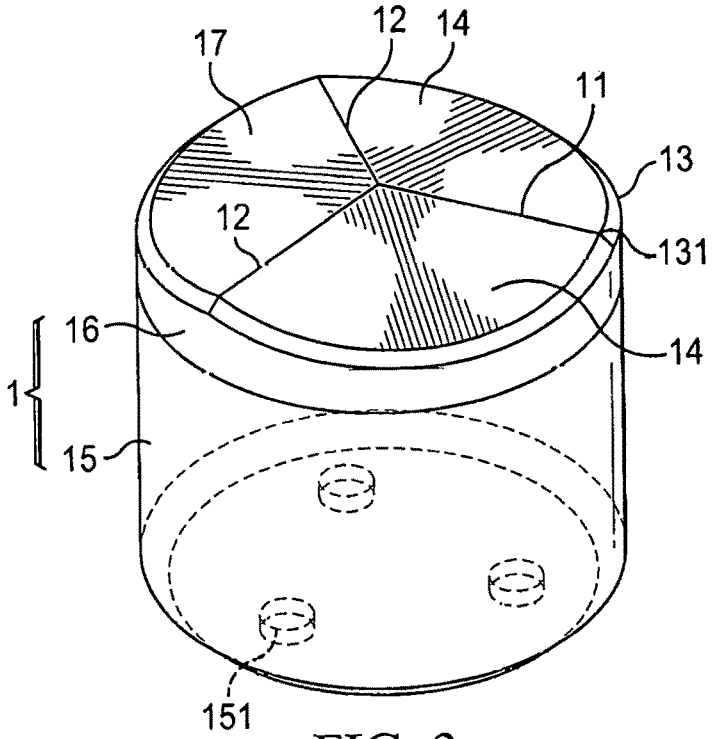
FIG. 3 is a schematic drawing of a convex ridge type non-planar cutting tooth in accordance with one embodiment disclosed herein.
Figure 4:
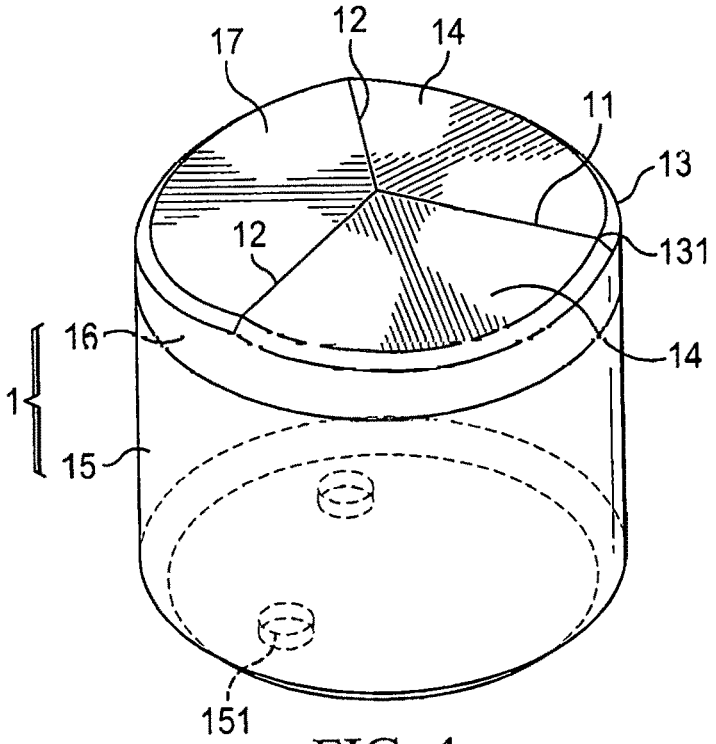
FIG. 4 is a schematic drawing of a convex ridge type non-planar cutting tooth in accordance with another embodiment disclosed herein.

In one embodiment of the present invention, as shown in FIGS. 3 and 4, the back surface 17 is a back bevel, that is, the back bevel is inclined outwardly and downwardly from the horizontal plane along the axial direction. In this embodiment, the main cutting convex ridge 11 and the two non-cutting convex ridges 12 divide the upper surface of the polycrystalline diamond layer 16 into three slopes, i.e., two cutting bevels 14 and a back bevel. The main cutting convex ridge 11 and the two non-cutting convex ridges 12 may be used as tool ridges when cutting rocks. In this case, the non-cutting convex ridge 12 is transformed into the main cutting convex ridge 11, after being used, the cutting tooth can be rotated a certain angle to another convex ridge by brazing and be reused as new ridge tool. For example, when the main cutting convex ridge 11 is used as a tool ridge to cut rock, after being used, rotating the convex ridge type non-planar cutting tooth to a position that a non-cutting convex ridge 12 acts as a new tool ridge, such that the convex ridge type non-planar cutting tooth can be used repeatedly. The convex ridge type non-planar cutting tooth of this embodiment is used in repairable drill bit.

In another embodiment of the present invention, referring back to FIG. 1, the back surface 17 is a back plane, i.e., the back plane is parallel to the horizontal plane, and the two cutting bevels are inclined outwardly and downwardly from the horizontal plane alone axial direction. That is, in this embodiment, the main cutting convex ridge 11 and the two non-cutting convex ridges 12 divide the upper surface of the polycrystalline diamond layer 16 into two slopes and one plane, and the main cutting convex ridge 11 is used as tool ridge to cut rocks. The convex ridge type non-planar cutting tooth of this embodiment is used in irreparable drill bit.

In different applications, according to cost demand, the number of slopes of the upper surface the polycrystalline diamond layer 16 of the present invention is designed to two or three, in order to optimize the manufacturing cost.

According to one embodiment of the present invention, referring to FIG. 2, the angle θ between the two cutting bevels 14 is 150 ° to 175 °. The angle θ is determined by needs of actual formation. From the laboratory test of the wear ratio of the convex ridge type non planar cutting tooth, it is found that the smaller the angle, the tooth wear ratio is lower. Therefore, when drilling into high abrasive formation, the value of the angle θ should be larger. In one embodiment of the present invention, in a high impact but medium abrasive formation, the value of the angle θ is 160°. In a high abrasive formation such as sandstone formation, the value of the angle θ can be 170° to 175°. The angle θ of the present invention can be designed to different value according to performance requirements, thus to optimize the operation results.

According to one embodiment of the present invention, the main cutting ridge 11 has a length of ½ to ⅔ times of the diameter of the cylindrical body 1, the benefits of this kind of design are to improve the ability of impact and balling resistance of the convex ridge type non planar cutting tooth.

In a particular embodiment, shown in FIG. 3, the convex ridge type non planar cutting tooth is a 120 degrees rotationally symmetric cutting tooth, i.e., the angle between the main cutting convex ridge 11 and the two non-cutting convex ridges 12 are 120 degrees respectively, the angle between the two non-cutting convex ridges 12 is also 120 degrees, and the length of the main cutting convex ridge 11 is equal to that of the non-cutting convex ridges 12. In another embodiment, shown in FIG. 4, the convex ridge type non planar cutting tooth is not a rotationally symmetric cutting tooth, i.e. the angle between the two non-cutting convex ridges 12 is larger than the angles between the main cutting convex ridge 11 and the two non-cutting convex ridges 12. In this embodiment, the main cutting convex ridge 11 has a length larger than that of the non-cutting convex ridges 12.

Figure 11:
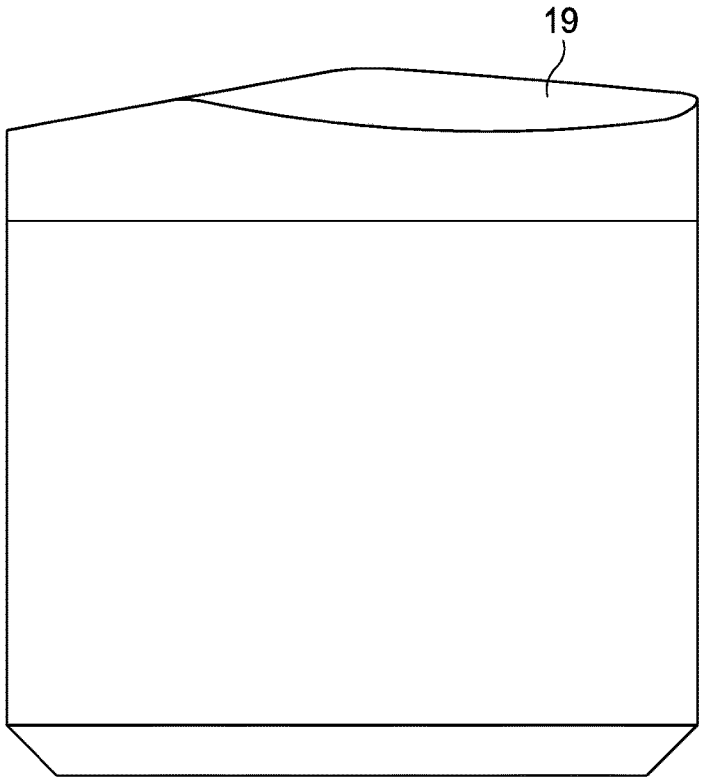
FIG. 11 depicts a side view of a convex ridge type non-planar cutting tooth in accordance with one embodiment discloses herein.

FIG. 11 depicts a side view of a convex ridge type non-planar cutting tooth with cutting ridge 19.

The manufacturing process of the convex ridge type non planar cutting tooth of the present invention is as follows:

In the first place, conventional plane type diamond composite sheet is fabricated by high temperature and high pressure sintering and then is processed by centerless grinding, after the outer diameter achieves the design requirements, polishing the top layer of the diamond composite sheet to conventional plane type on diamond millstone, and then the required top slope is machined on the surface of the diamond composite layer by electrical discharge machining (EDM), The process need not one-time forming of the required diamond slope during sintering.

EDM is a kind of method to process the size of materials which employs the corrosion phenomena produced by spark discharge. In a low voltage range, EDM performs spark discharge in liquid medium. EDM is a self-excited discharge, which is characterized as follows: before discharge, there is a higher voltage between two electrodes used in spark discharge, when the two electrodes are close, the dielectric between them is broken down, spark discharge will be generated. In the process of the break down, the resistance between the two electrodes abruptly decreases, the voltage between the two electrodes is thus lowered abruptly. Spark channel must be promptly extinguished after maintaining a fleeting time, in order to maintain a "cold pole" feature of the spark discharge, that is, there's not enough time to transmit the thermal energy produced by the channel energy to the depth of the electrode. The channel energy can corrode the electrode partially. When processing diamond composite sheet with EDM, since the residual catalyst metal cobalt produced in the process sintering diamond composite sheet having conductivity, the diamond composite sheet can be used as electrodes in the EDM, and thus can be machined by EDM.

EDM can avoid the error caused by the inability to accurately control the diamond shrinkage during sintering process. EDM technology can effectively control the machining accuracy, and reduce the damage to the diamond layer during the machining process. Convex ridge type tooth formed by electric spark machining have characteristics of high processing precision, low cost, small damage to the surface of the diamond layer and so on. When processing the convex ridge type non-planar cutting tooth, one can prefabricate plane type diamond composite layer at first, and then perform precision machining through EDM. The whole process cost can be reduced, the machining accuracy is satisfied, and the damage to the surface of the diamond composite layer is minimal. There is no need to develop sintering cavity assembly for the diamond composite layer, thus having good flexibility and low-cost.

The convex ridge type non-planar cutting teeth of the present invention change the traditional plane cylindrical cutting tooth design into convex ridge type non-planar cutting tooth, which can greatly improve the ability of positive direction impact resistance of the cutting tooth. In addition, the main cutting convex ridge 11 which is located at the outer end of the edge 13 of the upper surface of the polycrystalline diamond layer 16 acts as a cutting point 131. Chamfered surfaces 18 are present. In the process of cutting, the debris can be automatically formed into two branches from the cutting point 131, and can be squeezed out from the cutting bevels 14 on both sides of the main cutting convex ridge 11, such that the debris is prevented from sliding to the body part of the blade along the upper surface of the polycrystalline diamond layer 16 and forming balling, thus greatly improving the ability of balling resistance of the drill bit.

Example 2

Figure 5:
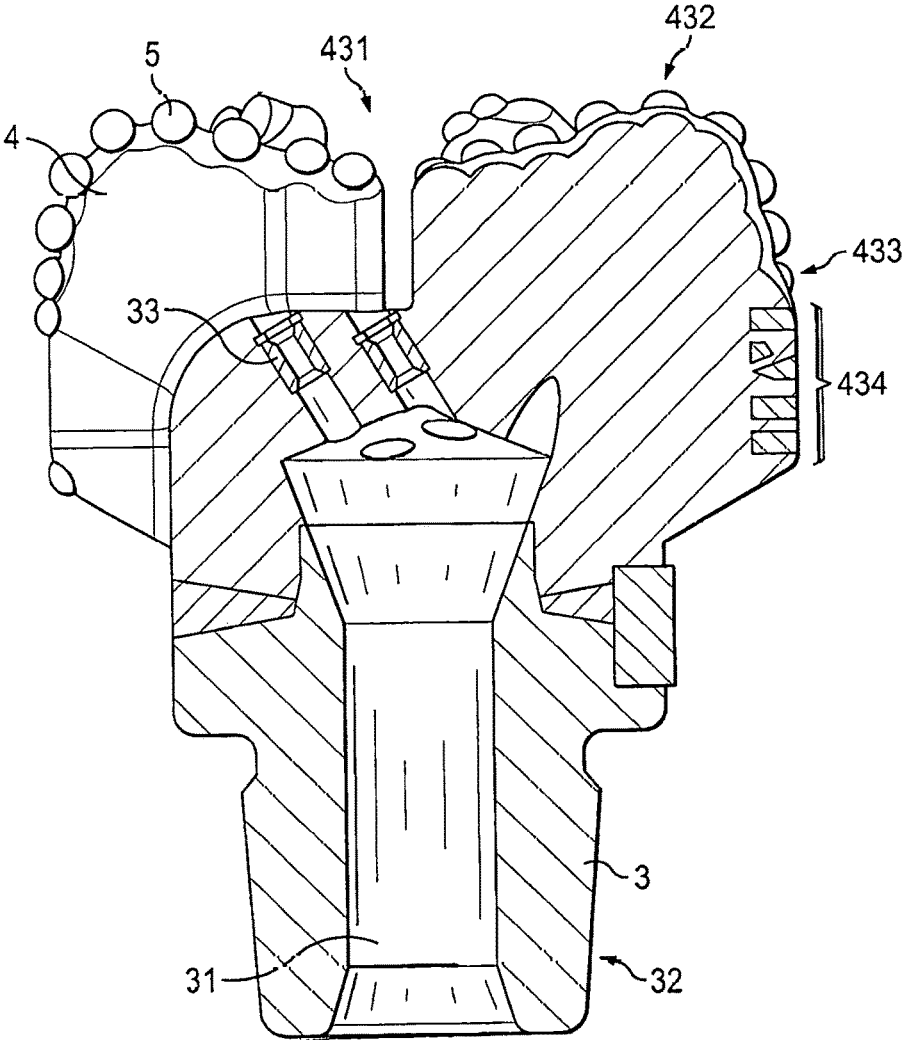
FIG. 5 is a section view of a diamond drill bit having convex ridge type non-planar cutting teeth in accordance with one embodiment disclosed herein.

As shown in FIG. 5, the present invention also provides a diamond drill bit, which comprises a drill bit body 3 and a plurality of blades 4, wherein: the drill bit body 3 is equipped with an axial through water channel 31 therein, a connection portion 32 is formed at one end of the drill bit body 3, the other end of the drill bit body 3 is provided with a plurality of water holes 33 which can communicate with the water channel 31; a plurality of blades 4 connected to the other end of the drill bit body 3 in the circumferential direction, one side of each of the blade 4 equipped with a plurality of cutting teeth 5 side by side, the plurality of cutting teeth 5 comprise convex ridge type non-planar cutting teeth 10 as described in Example 1.

Specifically, the drill bit body 3 is substantially cylindrical, the connection portion 32 has a threaded section and is used to connect to a drill string. The power is transmitted to the diamond drill bit by the drill string. There is the water channel 31 in the middle part of the drill bit body 3, and the water channel 31 communicates with the connection portion 32, the other end of the drill bit body 3 is provided with a plurality of water holes 33 which can communicate with the water channel 31.

A plurality of blades 4 connected to the end of the drill bit body 3 provided with a plurality of water holes 33. In the present invention, the blade 4 has an inner side surface 41 and an outer side surface 42, a top surface 43 of the blade is connected between the inner side surface 41 and outer side surface 42. The plurality of the cutting teeth 5 are disposed on the outer edge of the top surface 43 of the blade and near the inner side surface 42; furthermore, the top surface 43 of the blade comprises a heart portion 431, a nose portion 432, a shoulder portion 433 and a gauge protection portion 434 connected in turn which are extended from the center shaft diameter of the drill bit body 3 to outside, the heart portion 431 is close to the central axis of the drill bit body 3, the gauge protection portion 434 is located on the side wall of the drill bit body 3 and the cutting teeth 5 are distributed across the heart portion 431, the nose portion 432, the shoulder portion 433 and the gauge protection portion 434 of the blade 4.

Wherein, in one embodiment, the convex ridge type non-planar cutting teeth 10 and the cutting teeth 5 are arranged in a staggered arrangement along the axial direction of the drill bit body 3, that is, among the plurality of the cutting teeth 10 disposed on the outer edge of the top surface 43 of the blade and near the inner side surface 42, a conventional traditional plane cutting teeth 5 is arranged between the two convex ridge type non-planar cutting teeth 10.

If the balling is formed during drilling, it is usually that the debris begins to gather to the position of the heart portion 431 of the drill bit, because in this region, due to the limited space of the blades 4 and area which mud sprayed from the water holes 33 flows through being small, the region has the minimum ability to discharge debris. Therefore, in the application of easy balling formation, convex ridge cutting tooth can be arrange at the position of the heart portion 431 of the drill bit to reduce the possibility of forming bit balling.

Figure 6:
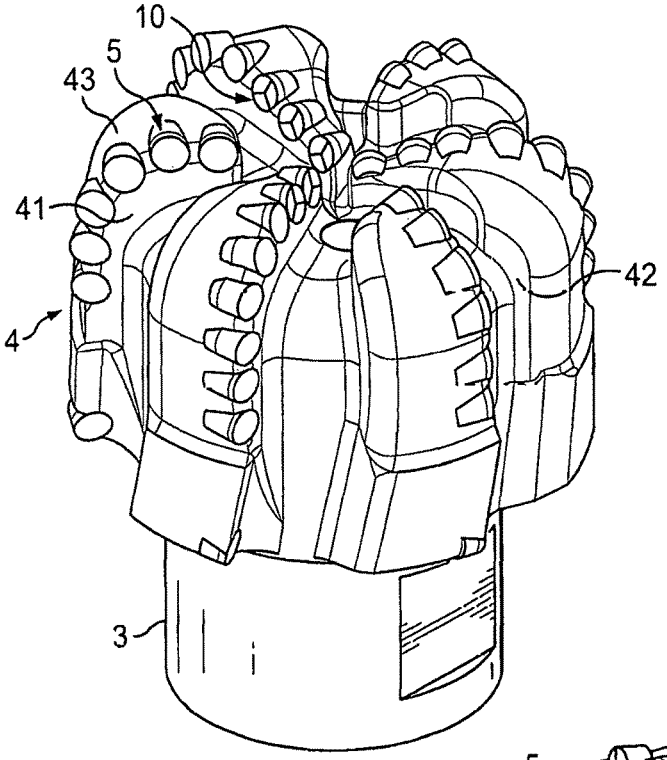
FIG. 6 is a perspective view of the arrangement of teeth of a diamond drill bit having convex ridge type non-planar cutting teeth in accordance with one embodiment disclosed herein.

As shown in FIG. 6, in one embodiment of the present invention, the convex ridge type non-planar cutting teeth are arranged on the heart portion 431 of the blade 4. When drilling into the easy balling formation, in many times, because of the arrangement of the drill bit and the limitation of the power limit of the ground mud pump, the drill bit is easy to generate balling from the heart portion. Convex ridge cutting teeth can be arrange at the position of the heart portion 431 such that the size of the debris produced by teeth located at the heart portion 431 can be reduced, and the debris is easier to be carried out by the drilling fluid, in order to reduce the risk of forming bit balling.

Figure 7:
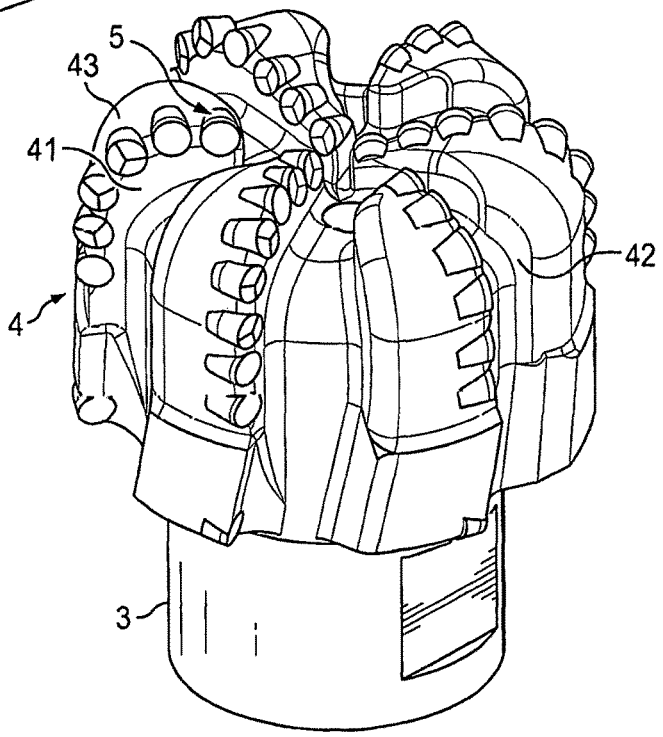
FIG. 7 is a perspective view of the arrangement of teeth of a diamond drill bit having convex ridge type non-planar cutting teeth in accordance with another embodiment disclosed herein.

As shown in FIG. 7, in another embodiment, the convex ridge type non-planar cutting teeth are arranged on the shoulder portion 433 of the blade 4. When drilling into high gravel content and so on formations, because the teeth located at the shoulder portion have a higher line speed and cutting power, they are more likely to withstand positive impact when the drill bit vibrates at the bottom of the well, causing the damage to diamond composite sheet, reducing the mechanical speed and footage. In this case, the convex ridge type non-planar cutting teeth are arranged on the shoulder portion 433 to improve the ability of impact resistance of the drill bit.

Of course, in other embodiments, the cutting teeth on the diamond drill bit can also all be convex ridge type non-planar cutting teeth. This kind of drill bit can be used in the formation of readily severe balling. The convex ridge type non-planar cutting teeth at the heart portion can improve the property of anti-bit balling. The cost of the drill bit employing all convex ridge type non-planar cutting teeth is higher than the diamond drill bit in FIG. 7.

In addition, the tooth at the shoulder portion usually bears the maximum cutting power during drilling When drilling into high impact formation, because the teeth located at the shoulder portion have a higher line speed, they are easy to bear the impact force from the circumferential direction which leads to the collapse of the teeth. When drilling into this kind of formation, the convex ridge type non-planar cutting teeth are arranged on the shoulder portion and the outer side of the nose portion, thus to improve the ability of impact resistance of the cutting teeth in these areas, and to improve the life of the drill bit.

Figure 10:
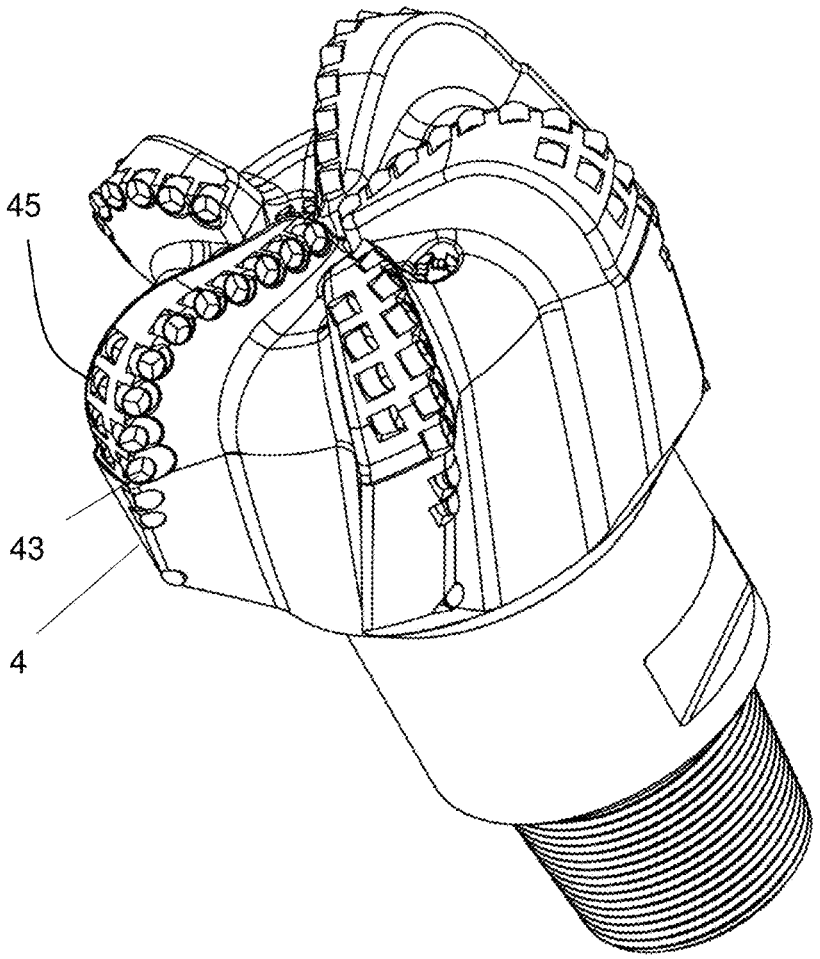
FIG. 10 depicts a perspective view of the arrangement of teeth of a diamond drill bit having a plurality of secondary cutting teeth in accordance with one embodiment disclosed herein.

In another embodiment of the present invention, a plurality of blades 4 are further provided with a plurality of secondary cutting teeth 45. FIG. 10. The secondary cutting teeth 45 are arranged in the back row of the cutting teeth 5 along the rotary cutting direction of the drill bit body, the plurality of secondary cutting teeth 45 include convex ridge type non-planar cutting teeth 10. Specifically, the convex ridge type non-planar cutting teeth 10 can also depose on the top surface 43 of the shoulder portion 433 of the blade, i.e., at the position of the secondary cutting teeth 45. When the convex ridge type non-planar cutting teeth depose on the top surface 43 (i.e., at the position of the secondary cutting teeth 45) of the shoulder portion 433 of the blade, they are "embedded" within the blades 4 by brazing.

In the diamond drill bit of the present invention, the convex ridge type non-planar cutting teeth are arranged in the heart portion 431, nose portion 432 and shoulder portion 433 of the blade 4 of the drill bit, to accommodate the needs of different formation drilling.

Example 3

Description of its functionality when drilling hard and brittle rock

Figure 8:
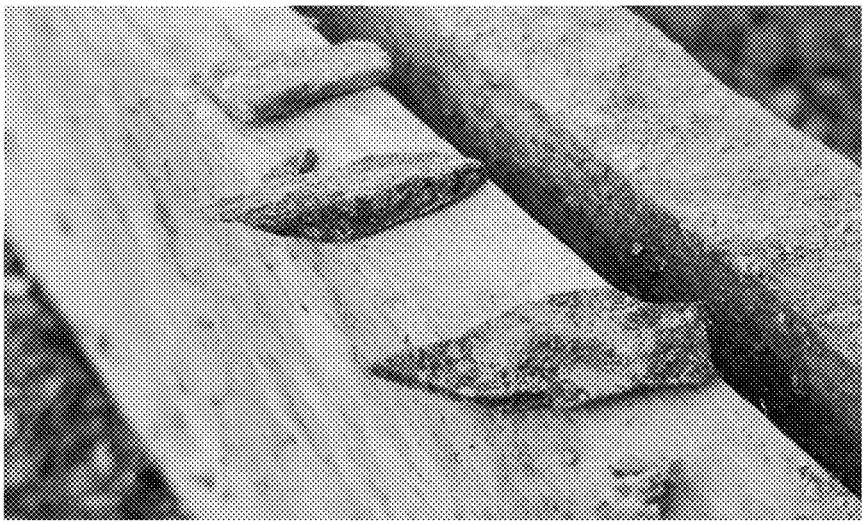
FIG. 8 depicts cuttings formed along the cleavage plane of hard and brittle rock.

The convex cutter induces a stress concentration point when the bit drills into a heterogeneous formation and engages on the harder rock. Other than the regular flat cutter shears off the rock, the rock creates a crack initiation point and the contacting ridge. The rock breaks through its cleavage plane through each side and forms two cuttings along the cleavage plane as shown in FIG. 8.

Example 4

Figure 9:
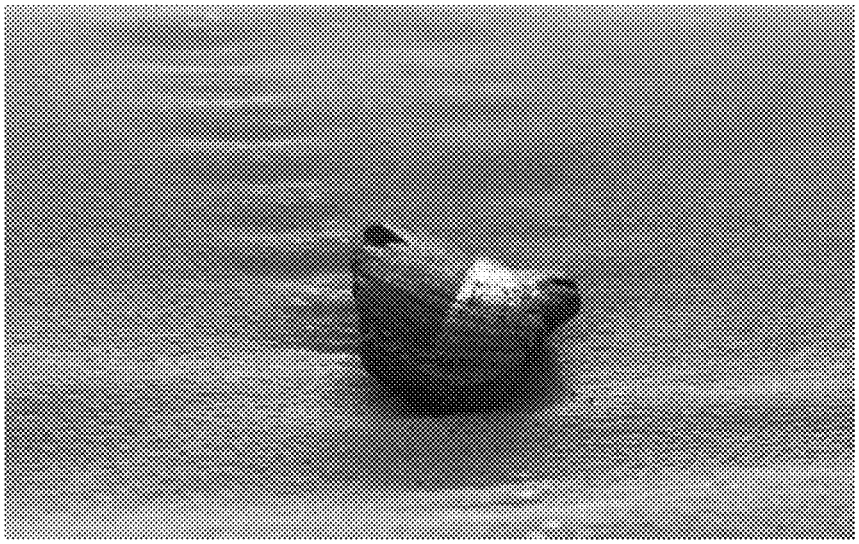
FIG. 9 depicts cuttings formed when drilling into sandstone and mudstone.

Description of drilling into sandstone and mudstone and the indicator for bit work life When drilling into sandstone and mudstone, the convex ridge cutter creates a deformation of the rock. FIG. 9. The angle between two side planes of the cutting ridge is designed to be within a range such that the ductile mudstone cuttings will form a unique cuttings shape and be evacuated as a whole. Unlike a regular PDC bit, when the bit is getting to its end of life and the associated cuttings are fragment compared to the cuttings when the bit is new, this convex ridge cutter bit always creates this V shaped cutting and the width of this V shape grows wider when the bit is getting to its end of life.

Example 5

Description of drilling into sandstone and mudstone and the efficiency improvement As shown in FIG. 9, when drilling into sandstone and mudstone along the entire bit work life, the cuttings are formed with V shape, indicating that the free plane of cuttings is smaller than the cuttings created by the regular flat surface cutter bit. From the drilling response, it is shown the required torque for the convex ridge cutter bit is lower than the flat surface cutter bit, which means a better drilling efficiency is achieved.

The above described are only several embodiments of the present invention. Based on the contents disclosed in the present invention, those skilled in the art may make various modifications or variations without departing from the spirit and scope of the invention.

What is claimed is:

1. A convex ridge type non-planar cutting tooth comprising a cylindrical body, the surface of the end portion of the cylindrical body is provided with a main cutting convex ridge and two non-cutting convex ridges, the inner end of the main cutting convex ridge and the inner ends of the two non-cutting convex ridges converge at the surface of the end portion of the cylindrical body, the outer end of the main cutting convex ridge and the outer ends of the two non-cutting convex ridges extend to the outer edge of the surface of the end portion of the cylindrical body, the surfaces of the end portion of the cylindrical body on both sides of the main cutting convex ridge are cutting bevels; and a cutting point located where the outer end of the main cutting convex ridge meets the outer edge of the surface of the end portion of the cylindrical body;

wherein the cutting point is a convergence of four surfaces, including two chamfered surfaces and two beveled surfaces, wherein the angle between the two beveled surfaces is 150° to 175°; and wherein the main cutting convex ridge is located where the cutting bevels abut;

wherein the main cutting convex ridge is a line; and wherein the cutting point is configured to divert cuttings to reduce a risk of bit balling.

2. The convex ridge type non-planar cutting tooth of claim 1, wherein the surface of the end portion of the cylindrical body between the two non-cutting convex ridges is a back bevel.

3. The convex ridge type non-planar cutting tooth of claim 1, wherein the surface of the end portion of the cylindrical body between the two non-cutting convex ridges is a back plane.

4. The convex ridge type non-planar cutting tooth of claim 1, wherein the cylindrical body comprises a base formed of tungsten carbide material and a polycrystalline diamond layer connected to the top of the base, the main cutting convex ridge and two non-cutting convex ridges are located on the upper surface of the polycrystalline diamond layer.

5. The convex ridge type non-planar cutting tooth of claim 1, wherein the length of the main cutting convex ridge is equal to that of the non-cutting convex ridges.

6. The convex ridge type non-planar cutting tooth of claim 1, wherein the length of the main cutting convex ridge is larger than that of the non-cutting convex ridges.

7. The convex ridge type non-planar cutting tooth of claim 1, wherein the length of the main cutting convex ridge is ½-⅔ times of the diameter of the cylindrical body.

8. A diamond drill bit, comprising:

a drill bit body equipped with an axial through water channel therein, a connection portion is formed at one end of the drill bit body, the other end of the drill bit body is provided with a plurality of water holes which can communicate with the water channel;

a plurality of blades connected to the other end of the drill bit body in the circumferential direction, one side of each of the blade equipped with a plurality of cutting teeth side by side, the plurality of cutting teeth comprise convex ridge type non-planar cutting teeth selected from claim 1.

9. The diamond drill bit of claim 8, wherein the blade has an inner side surface and an outer side surface, a top surface of the blade is connected between the inner side surface and outer side surface, the plurality of the cutting teeth are disposed on the outer edge of the top surface of the blade and near the inner side surface; the top surface of the blade comprises a heart portion, a nose portion, a shoulder portion and a gauge protection portion connected in turn which are extended from the center shaft diameter of the drill bit body to outside, the heart portion is close to the central axis of the drill bit body, the gauge protection portion is located on the side wall of the drill bit body and the cutting teeth are distributed across the heart portion, the nose portion, the shoulder portion and the gauge protection portion of the blade.

10. The diamond drill bit of claim 9, wherein the convex ridge type non-planar cutting teeth are arranged on the heart portion of the blade.

11. The diamond drill bit of claim 9, wherein the convex ridge type non-planar cutting teeth are arranged on the shoulder portion of the blade.

12. The diamond drill bit of claim 8, wherein the plurality of blades are further provided with a plurality of secondary cutting teeth, the secondary cutting teeth are arranged in the back row of the cutting teeth along the rotary cutting direction of the drill bit body, the plurality of secondary cutting teeth include the convex ridge type non-planar cutting teeth.

13. The diamond drill bit of claim 8, wherein the convex ridge type non-planar cutting teeth and the cutting teeth are arranged in a staggered arrangement along the axial direction of the drill bit body.

14. A diamond drill bit, comprising:

a drill bit body equipped with an axial through water channel therein, a connection portion is formed at one end of the drill bit body, the other end of the drill bit body is provided with a plurality of water holes which can communicate with the water channel;

a plurality of blades connected to the other end of the drill bit body in the circumferential direction, one side of each of the blade equipped with a plurality of cutting teeth side by side, the plurality of cutting teeth comprise convex ridge type non-planar cutting teeth selected from claim 2.

15. A diamond drill bit, comprising:

a drill bit body equipped with an axial through water channel therein, a connection portion is formed at one end of the drill bit body, the other end of the drill bit body is provided with a plurality of water holes which can communicate with the water channel;

a plurality of blades connected to the other end of the drill bit body in the circumferential direction, one side of each of the blade equipped with a plurality of cutting teeth side by side, the plurality of cutting teeth comprise convex ridge type non-planar cutting teeth selected from claim 3.

16. A diamond drill bit, comprising:

a drill bit body equipped with an axial through water channel therein, a connection portion is formed at one end of the drill bit body, the other end of the drill bit body is provided with a plurality of water holes which can communicate with the water channel;

a plurality of blades connected to the other end of the drill bit body in the circumferential direction, one side of each of the blade equipped with a plurality of cutting teeth side by side, the plurality of cutting teeth comprise convex ridge type non-planar cutting teeth selected from claim 4.

17. A diamond drill bit, comprising:

a drill bit body equipped with an axial through water channel therein, a connection portion is formed at one end of the drill bit body, the other end of the drill bit body is provided with a plurality of water holes which can communicate with the water channel;

a plurality of blades connected to the other end of the drill bit body in the circumferential direction, one side of each of the blade equipped with a plurality of cutting teeth side by side, the plurality of cutting teeth comprise convex ridge type non-planar cutting teeth selected from claim 7.

18. A diamond drill bit, comprising:

a drill bit body equipped with an axial through water channel therein, a connection portion is formed at one end of the drill bit body, the other end of the drill bit body is provided with a plurality of water holes which can communicate with the water channel;

a plurality of blades connected to the other end of the drill bit body in the circumferential direction, one side of each of the blade equipped with a plurality of cutting teeth side by side, the plurality of cutting teeth comprise convex ridge type non-planar cutting teeth selected from claim 5.

19. A diamond drill bit, comprising:

a drill bit body equipped with an axial through water channel therein, a connection portion is formed at one end of the drill bit body, the other end of the drill bit body is provided with a plurality of water holes which can communicate with the water channel;

a plurality of blades connected to the other end of the drill bit body in the circumferential direction, one side of each of the blade equipped with a plurality of cutting teeth side by side, the plurality of cutting teeth comprise convex ridge type non-planar cutting teeth selected from claim 6.

* * * * *